US011047638B1

(12) United States Patent
Xu

(10) Patent No.: US 11,047,638 B1
(45) Date of Patent: Jun. 29, 2021

(54) LASER SIGHT TRIGGER GUARD FOR A HANDGUN

(71) Applicant: Ye Xu, Sugar Land, TX (US)

(72) Inventor: Ye Xu, Sugar Land, TX (US)

( * ) Notice: Subject to any disclaimer, the term of this patent is extended or adjusted under 35 U.S.C. 154(b) by 0 days.

(21) Appl. No.: 16/808,890

(22) Filed: Mar. 4, 2020

(51) Int. Cl.

| | |
|---|---|
| ***F41A 19/11*** | (2006.01) |
| ***F41G 1/35*** | (2006.01) |
| ***F41A 17/54*** | (2006.01) |
| ***F41G 3/26*** | (2006.01) |

(52) U.S. Cl.
CPC ..... *F41A 19/11* (2013.01); *F41A 17/54* (2013.01); *F41G 1/35* (2013.01); *F41G 3/2655* (2013.01)

(58) Field of Classification Search
CPC ..... F41A 17/54; F41A 19/11; F41G 1/35
See application file for complete search history.

(56) References Cited

U.S. PATENT DOCUMENTS 3,269,046 A * 8/1966 Schaefer ..... F41A 17/54 42/70.06
5,012,605 A * 5/1991 Nishioka ..... F41A 17/54 42/70.07
5,024,017 A * 6/1991 Nishioka ..... F41A 17/54 42/70.07
6,154,995 A * 12/2000 Lenoir ..... F41A 17/06 42/70.07
9,097,479 B1 * 8/2015 Barido ..... F41A 17/54
9,459,064 B1 * 10/2016 Xu ..... F41A 17/54
10,837,724 B2 * 11/2020 Bordley ..... F41A 17/54
2013/0074351 A1 * 3/2013 Kowalczyk ..... F41G 1/36 33/286
2014/0182180 A1 * 7/2014 Murphy, II ..... F41A 17/54 42/70.07
2017/0023324 A1 * 1/2017 Xu ..... F41A 17/54

* cited by examiner

*Primary Examiner* — Gabriel J. Klein
(74) *Attorney, Agent, or Firm* — Benjamin Aaron Adler

(57) ABSTRACT

Provided herein is a laser sight trigger guard for a handgun that enables a user to simultaneously switch on a laser as the trigger guard is moved before firing. The trigger guard has a first component that houses a laser assembly and a second component that covers the trigger when the handgun is not in use. The second component is pivotably attached to the first component. The laser assembly has a laser unit, an on off switch and a power supply. When unpivoted, the second component covers the trigger and the laser is kept in an off state. When pivoted, the second component no longer covers the trigger enabling the laser to switch on and to simultaneously provide access to the trigger.

18 Claims, 4 Drawing Sheets

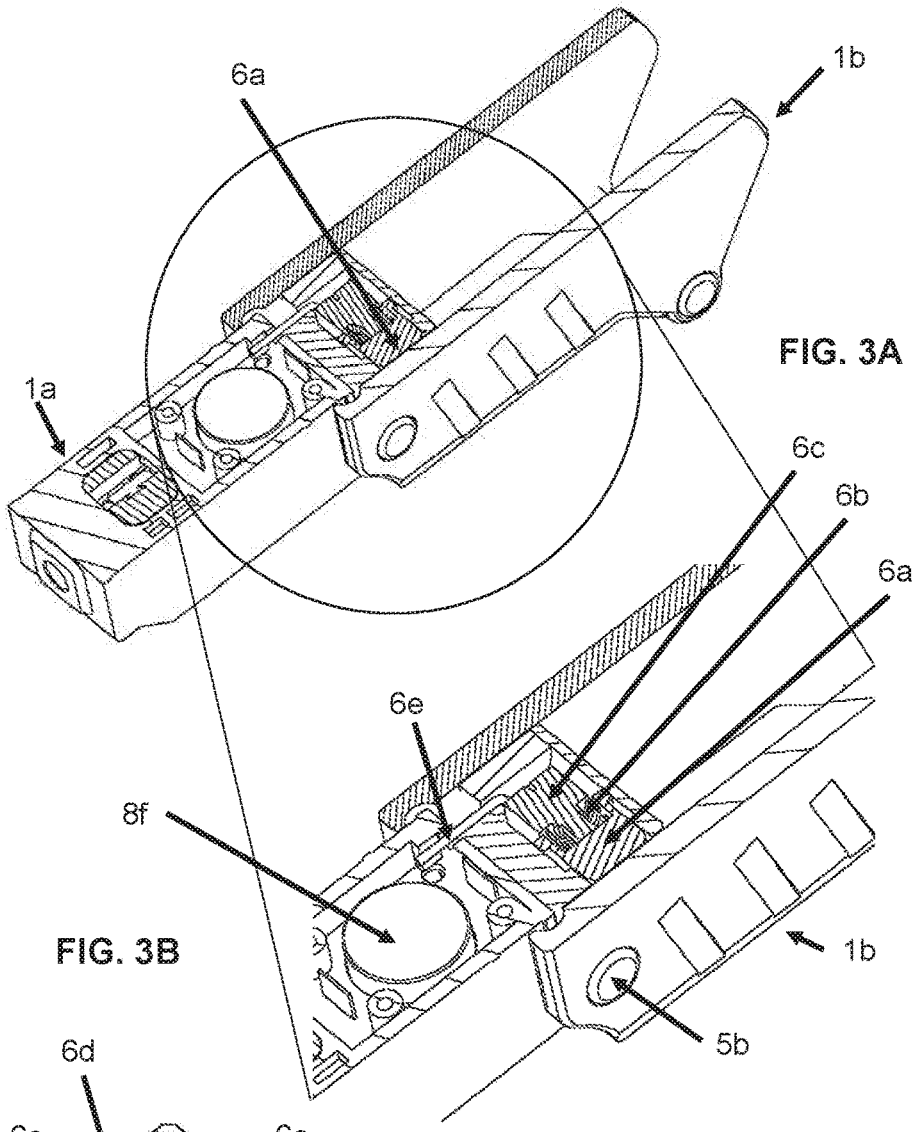
FIG. 3A
FIG. 3B
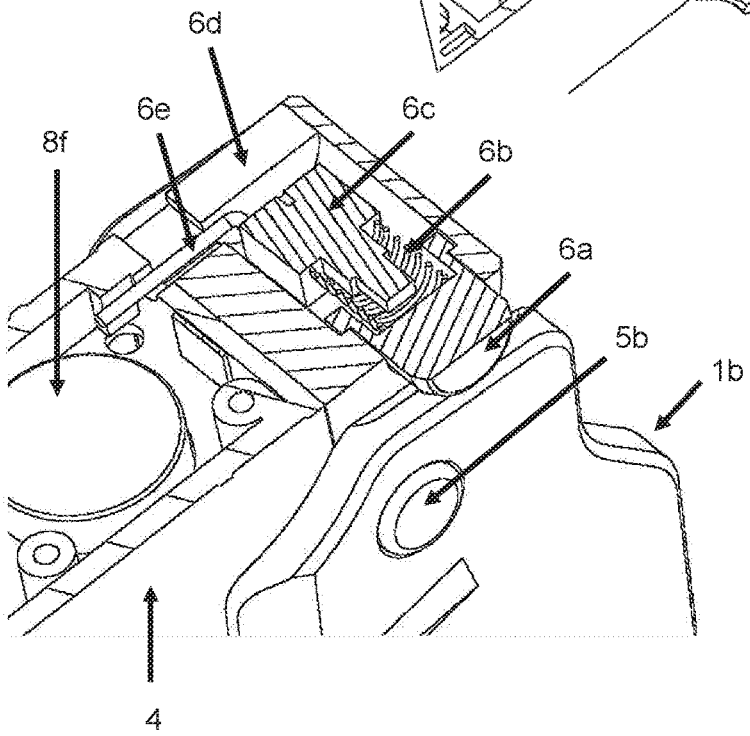
FIG. 3C

LASER SIGHT TRIGGER GUARD FOR A HANDGUN

BACKGROUND OF THE INVENTION

Field of the Invention

The present invention generally relates to the field of handgun accessories. More specifically, the present invention relates to a device comprising an interactive laser sight and trigger guard for a handgun.

Description of the Related Art

Handguns are used for protection and self-defense by law enforcement as well as the general public. Handguns like pistols are convenient to use in a life threatening emergency since they can be quickly drawn from a concealed location on the body of the user and fired at a target when threatened. When handguns like pistols are carried in a concealed fashion, they are often kept in users' pockets or bags without holsters, along with items such as keys, lipsticks, and pens. These items could be accidently inserted into trigger guards and result in unintentional trigger fire. Even when held in holsters, they still can be accidentally fired while being removed or inserted into the holsters. Furthermore, a handgun also could be unintentionally fired by a child or an unauthorized person in a home environment.

Many external safety devices have been developed over the years to provide extra safety features that prevent unintended or unauthorized access to the trigger. For example, a detachable gun trigger guard was developed to attach to the rear housing of a gun trigger guard, spanning between a gun trigger and the rear portion of the trigger guard to stop the trigger moving backwards. Similar trigger guards include a shackle that directly inserts though the trigger guard and prevents triggers from actuating. Other trigger guards include triggers with a body design to self-conform to, or affix to the trigger guards with structures to enable trigger guards rotating between on and off positions. Another trigger guard is inserted into a handgun stock. This trigger guard can be released by actuating a first and a second lever, which are located on opposite sides of the handgun.

However, these external trigger guards generally require several steps to be dismissed before the gun can point quickly at a target before firing. Many external trigger guards require coordination of several fingers to remove. This is inconvenient especially when a handgun is needed urgently. Moreover, many of these trigger guards occupy a large portion of handguns, defeating the purpose of the portability of using a handgun and hindering the use of other accessories on it. The life-saving benefits of having a concealed pistol can only be realized if the user is able to aim accurately at the target before firing. To address this, many aftermarket laser attachment accessories are available for handguns to help users quickly point the barrel at the target so repeated firing and accidently shooting of unintended individuals is avoided.

Currently, laser sights and trigger guards are available as separate accessories that are attachable to a pistol. As a result, the user would need to remove the concealed handgun, move the trigger guard to access the trigger, switch on the laser and verify the barrel is pointing at the target before firing. This entire process would lose several precious seconds particularly when circumstances are dire such as in a life-threatening situation.

Thus there is a deficiency in the art for devices that can greatly reduce speed of accurately firing a gun by quickly enabling both the laser sighting and firing steps. The present invention fulfills this long standing need and desire in the art.

SUMMARY OF THE INVENTION

The present invention is directed to a laser sight trigger guard for a handgun. The laser sight trigger guard comprises a first component securable to a gun barrel on the handgun and a second component pivotably secured to the first component at the distal end. The first component comprises a body, a rail mount and a laser assembly. The body comprises a first side and a second side, parallel to each other, a hollow proximal end with an opening on a front surface, and a distal end with three laterally formed compartments at a back surface having at least one coverable open ends. On a top surface of the proximal end of the body is a rail mount that is engageable with a rail on the gun barrel. The laser assembly is located within the body of the first component. The second component comprises a first side member and a second side member connected that are parallel to each other and in a coverable relationship with a trigger on the handgun. An attachment shaft is attached to the first side member and the second side member at their distal ends. The present invention is directed to a related laser sight trigger guard further comprising a belt clip attached to the second component.

The present invention is directed to a laser sight trigger guard for a handgun. The laser sight trigger guard comprises a first component securable to a gun barrel on the handgun and a second component pivotably secured to the first component at the distal end. The first component comprises a body, a rail mount and a laser assembly. The body comprises a first side and a second side, parallel to each other, a hollow proximal end with an opening on a front surface, and a distal end with three laterally formed compartments at a back surface having at least one coverable open ends. On a top surface of the proximal end of the body is a rail mount that is engageable with a rail on the gun barrel. The laser assembly is located within the body of the first component. The laser mount consists of a laser unit, an on-off laser switch and a power supply in electrical communication with the laser unit and the on-off laser switch. The laser unit consists of a laser source in optical alignment with the opening formed on the front surface of the proximal end in the body. The on-off laser switch is within the first compartment and is in on-off communication with the laser source. The on-off laser switch is an off position when the second component is disposed around the trigger and in an on position when the second component is disposed around the first component. The power supply is in electrical communication with the laser unit and the on-off laser switch and consists of a battery receptacle and at least one battery seated in the receptacle and operably connected to the laser unit. The second component comprises a first side member and a second side member that are parallel to each other and in a coverable relationship with a trigger on the handgun. An attachment shaft is attached to the first side member and the second side member at their distal ends. The present invention is directed to a related laser sight trigger guard that further comprises a belt clip attached to the second component.

Other and further aspects, features, and advantages of the present invention will be apparent from the following description of the presently preferred embodiments of the invention given for the purpose of disclosure.

BRIEF DESCRIPTION OF THE DRAWINGS

So that the matter in which the above-recited features, advantages and objects of the invention, as well as others that will become clear, are attained and can be understood in detail, more particular descriptions of the invention briefly summarized above may be by reference to certain embodiments thereof that are illustrated in the appended drawings. These drawings form a part of the specification. It is to be noted, however, that the appended drawings illustrate preferred embodiments of the invention and therefore are not to be considered limiting in their scope.

FIG. 1A shows the clamp and laser assembly components of the laser sight trigger guard. FIG. 1B shows the trigger guard component of the laser sight trigger guard. FIG. 1C shows the laser sight trigger guard with the trigger guard in the unswiveled position. FIG. 1D shows the laser sight trigger guard with the trigger guard in the swiveled position. FIG. 1E is a front to back view of the laser sight trigger guard with the trigger guard in the swiveled position.

FIGS. 3A-3C is bottom view of the laser sight trigger guard. FIG. 3A is a bottom view of the laser sight trigger guard showing the on/off button in a depressed off position by the unswiveled trigger guard. FIG. 3B is a magnified view of the encircled region in FIG. 3A. FIG. 3C is a view of the magnified region in FIG. 3B showing the on/off button released to the on position when the trigger guard is swiveled.

FIG. 4A shows the laser sight trigger guard with the trigger guard unswiveled and covering the trigger. FIG. 4B shows the laser sight trigger guard with the trigger guard swiveled by 180° to activate the laser and uncover the trigger.

DETAILED DESCRIPTION OF THE INVENTION

Figure 1A:
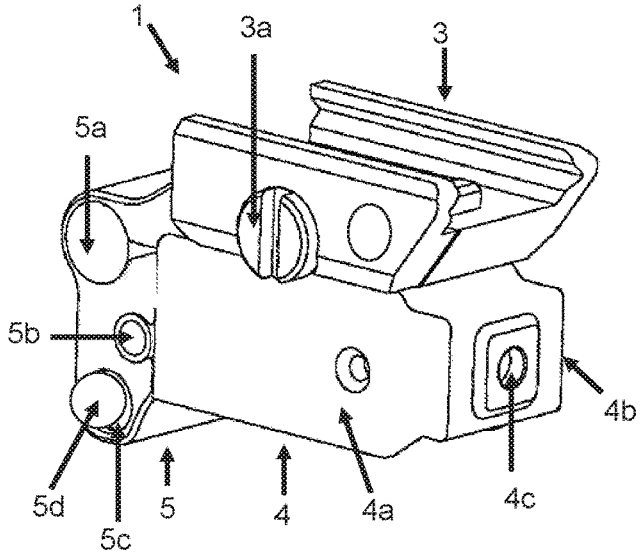
FIGS. 1A-1E depict the laser sight trigger guard.

As used herein in the specification, "a" or "an" may mean one or more. As used herein in the claim(s), when used in conjunction with the word "comprising", the words "a" or "an" may mean one or more than one.

As used herein "another" or "other" may mean at least a second or more of the same or different claim element or components thereof. Similarly, the word "or" is intended to include "and" unless the context clearly indicates otherwise. "Comprise" means "include."

As used herein, the terms "proximal" and "distal" in reference to the laser sight trigger guard disclosed herein refer to those components, features, parts and aspects thereof that are nearer or nearest to or farther or farthest from the muzzle of the handgun, respectively.

As used herein, the terms "handgun" or "gun" is used to refer to a "pistol" as is known in the art.

In one embodiment of the present invention, there is provided a laser sight trigger guard for a handgun comprising a first component securable to a gun barrel on the handgun comprising a body comprising a first side and a second side in parallel therewith, a hollow proximal end with an opening formed on a front surface thereof and a distal end with a first compartment, a second compartment and a third compartment each formed laterally through a back surface thereof and each independently having at least one coverable open end; a rail mount disposed on a top surface of the proximal end of the body engageable with a rail on the gun barrel; and a laser assembly disposed within the body of the first component; and a second component pivotably secured to the first component at the distal end thereof, comprising a first side member and a second side member connected thereto oppositely disposed in parallel in a coverable relationship with a trigger on the handgun; and an attachment shaft with a first end and a second end attached to the first side member and to the second side member at respective distal ends thereof. Further to this embodiment the laser sight trigger guard comprises a belt clip disposed on the second component.

In both embodiments the first compartment may comprise means for switching a laser on and off. Also in both embodiments the second compartment may comprise means for pivoting the second component through 180 degrees. Particularly, the means for pivoting the second component comprises a pivot with a first pivot end and a second pivot end disposed within the second compartment, where the first pivot end and the second pivot end pivotably connected to the first side member and to the second side member at respective proximal ends thereof through the open ends of the second compartment. In addition the third compartment may comprise means for reducing friction between the first component and the second component when the second component is pivoted through 180 degrees. Particularly, the means for reducing friction comprises a pair of ball bearing disposed at the open ends of the third compartment.

Also in both embodiments the rail mount further may comprise means for securing the rail mount to the rail. Also the second component may be configured to pivot in relation to a longitudinal axis of the gun barrel from 0° when the second component covers the gun trigger to 180° when the first side member and the second side member of the second component cover the first side and the second side of the first component.

In addition in both embodiments the laser assembly may comprises a laser unit comprising a laser source in optical alignment with the opening formed on the front surface of the proximal end in the body; an on-off laser switch disposed within the first compartment in on-off communication with the laser source, said on-off laser switch in an off position when the second component is disposed around the trigger and in an on position when the second component is disposed around the first component; and a power supply in electrical communication with the laser unit and the on-off laser switch. In one aspect the on-off laser switch comprises may comprise an on-off push button with an outer surface and an inner surface disposed through the open end of the first compartment on the second side of the first component with the outer surface protruding from the open end when the laser is on and the inner surface extending within the first compartment; an on-off sensor switch with a front end and a back end and means for contacting the power source disposed on the back end thereof, said on-off sensor switch disposed within the first compartment in alignment with and contactable by the inner surface of the on-off push button; a spring disposed between and abutting the inner surface of the on-off push button and the front end of the on-off sensor switch surface; and a cover disposed over the open end of the first compartment on the first side of the first component.

In one aspect of both embodiments the laser assembly may comprises a laser unit comprising a laser source in optical alignment with the opening formed on the front surface of the proximal end in the body; an on-off laser switch disposed within the first compartment in on-off communication with the laser source, said on-off laser switch in an off position when the second component is disposed around the trigger and in an on position when the second component is disposed around the first component; and a power supply in electrical communication with the laser unit and the laser switch. In this aspect the on-off laser switch may comprise an on-off push button with an outer surface and an inner surface disposed through the open end of the first compartment on the second side of the first component with the outer surface protruding from the open end when the laser is on and the inner surface extending within the first compartment; an on-off sensor switch with a front end and a back end and means for contacting the power source disposed on the back end thereof, said on-off sensor switch disposed within the first compartment in alignment with and contactable by the inner surface of the on-off push button; a spring disposed between and abutting the inner surface of the on-off push button and the front end of the on-off sensor switch surface; and a cover disposed over the open end of the first compartment on the first side of the first component. In another aspect the power supply may comprises a battery receptacle; at least one battery seated in the battery receptacle and operably connected to the on-off laser switch; and a slide switch connector seated in the battery receptacle in operable communication with the at least one battery and with the laser source.

In another embodiment of the present invention, there is provided a laser sight trigger guard for a handgun comprising a first component removably attached to a gun barrel comprising a body comprising a first side and a second side in parallel therewith, a hollow proximal end with an opening formed on a front surface thereof and a distal end with a first compartment, a second compartment and a third compartment each formed laterally through a back surface thereof and each independently having at least one coverable open end; a rail mount disposed on a top surface of the proximal end of the body engageable with a rail on the gun barrel; and a laser assembly disposed within the body of the first component, where the laser assembly comprises a laser unit comprising a laser source in optical alignment with the opening formed on the front surface of the proximal end in the body; an on-off laser switch disposed within the first compartment in on-off communication with the laser source, said on-off laser switch in an off position when the second component is disposed around the trigger and in an on position when the second component is disposed around the first component; and a power supply in electrical communication with the laser unit and the on-off laser switch, where the power supply comprises a battery receptacle and at least one battery seated therein operably connected to the laser unit; and a second component pivotably secured to the second component at the distal end thereof comprising a first side member and a second side member connected thereto oppositely disposed in parallel in a coverable relationship with a trigger on the handgun; and an attachment shaft with a first end and a second end attached to the first side member and to the second side member at respective distal ends thereof. Further to this embodiment the laser sight trigger guard comprises a belt clip disposed on the second component.

In both embodiments the second compartment may comprise means for pivoting the second component through 180 degrees. For example, the means for pivoting the second component comprises a pivot with a first pivot end and a second pivot end disposed within the second compartment, where the first pivot end and the second pivot end are pivotably connected to the first side member and to the second side member at respective proximal ends thereof through the open ends of the second compartment. Also the third compartment may comprise means for reducing friction between the first component and the second component when the second component is pivoted through 180 degrees. In addition the means for reducing friction may comprise a pair of ball bearing disposed at the open ends of the third compartment. In both embodiments the rail mount further comprises means for securing the rail mount to the rail. Also the second component is configured to pivot in relation to a longitudinal axis of the gun barrel from 0° when the second component covers the gun trigger to 180° when the first side member and the second side member of the second component cover the first side and the second side of the first component.

In both embodiments the on-off laser switch may comprise an on-off push button with an outer surface and an inner surface disposed through the open end of the first compartment on the second side of the first component with the outer surface protruding from the open end when the laser is on and the inner surface extending within the first compartment; an on-off sensor switch with a front end and a back end and means for contacting the power source disposed on the back end thereof, said on-off sensor switch disposed within the first compartment in alignment with and contactable by the inner surface of the on-off push button; a spring disposed between and abutting the inner surface of the on-off push button and the front end of the on-off sensor switch surface; and a cover disposed over the open end of the first compartment on the first side of the first component. Also the power supply may further comprise a slide switch connector seated in the battery receptacle and in operable communication with the at least one battery and with the laser source.

Particularly, embodiments of the present invention are better illustrated with reference to the Figure(s), however, such reference is not meant to limit the present invention in any fashion. The embodiments and variations described in detail herein are to be interpreted by the appended claims and equivalents thereof.

Provided herein is a laser sight trigger guard to conveniently and smoothly uncover and cover gun triggers with a single motion while simultaneously turning the laser on and off. FIG. 1A shows a first component 1*a* of the laser sight trigger guard. The first component has a body with a first side 4*a*, a second side 4*b*, a hollow proximal end 4 and a distal end 5. The proximal end has an opening 4*c* formed on a front surface. The opening enables the laser generated by the laser assembly (see FIG. 2) to exit the laser sight trigger guard and strike a target to improve accuracy of aim while discharging the gun. The distal end has a first compartment 5*a*, a second compartment 5*b* and a third compartment 5*c* each formed laterally through a back surface. Ball bearings represented by 5*d* are disposed within the third compartment on either end. A spring (not shown) is disposed between the ball bearings to keep them partially protruding from the openings on the third compartment such that the ball bearings reduce friction by rotating as the trigger guard pivots. A rail mount 3 is disposed on a top surface of the proximal end. The rail mount has a screw 3*a* to tighten the rail mount once it engages the rail on the gun barrel.

Figure 1B:
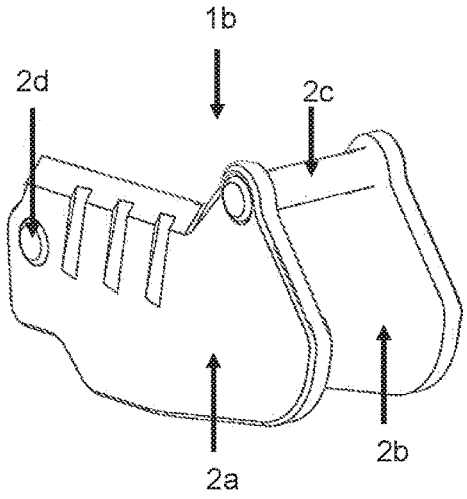

With continued reference to FIG. 1A, FIG. 1B shows a second component 1*b* of the laser sight trigger guard. The trigger guard comprises a first side member 2*a* that is attached to a second side member 2*b* by an attachment shaft 2*c* and a pivoting means 2*d* disposed within the second compartment in the first component. The second component prevents accidental discharge of the gun by covering the trigger when not in use.

Figure 1C:
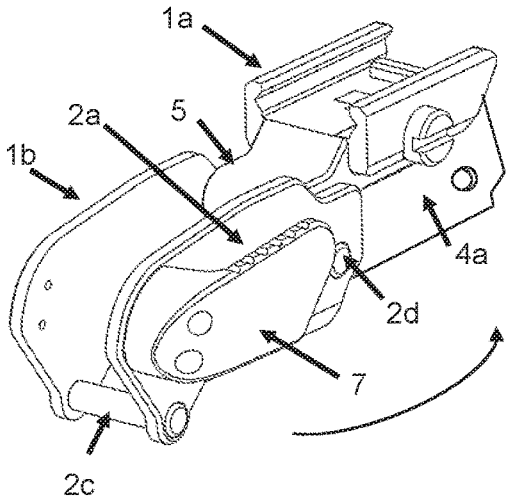

With continued reference to FIGS. 1A and 1B, FIG. 1C shows an assembled laser sight trigger guard 1 in the unpivoted 0° position with the second component 1*b* attached to the second compartment in the distal end 5 of the first component 1*a* by the pivoting means 2*d*. A belt clip 7 is attached to the first side member 2*a* in the second component and enables the user to secure the gun to a belt when not in use.

Figure 1D:
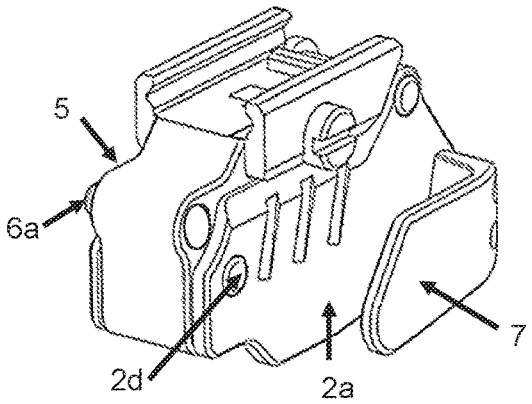

With continued reference to FIG. 1C, FIG. 1D shows the laser sight trigger guard in the 180° position after pivoting about pivoting means 2*d* in the direction showing by the arrow in FIG. 1C. Pivoting the trigger guard to the 180° position releases compressible on-off button 6*a*.

Figure 1E:
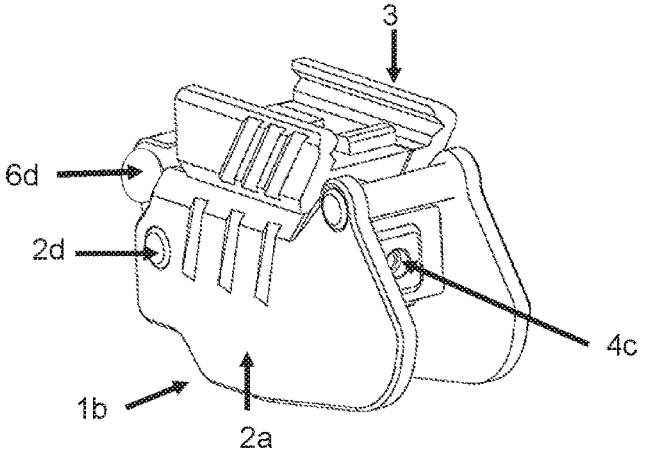

With continued reference to FIG. 1D, FIG. 1E shows the laser sight trigger guard in the 180° pivoted position showing the first side member 2*a* pivoting means 2*d*, cover 6*d* of the on-off laser switch and the opening 4*c* on the front surface at the proximal end of the first component.

Figure 2:
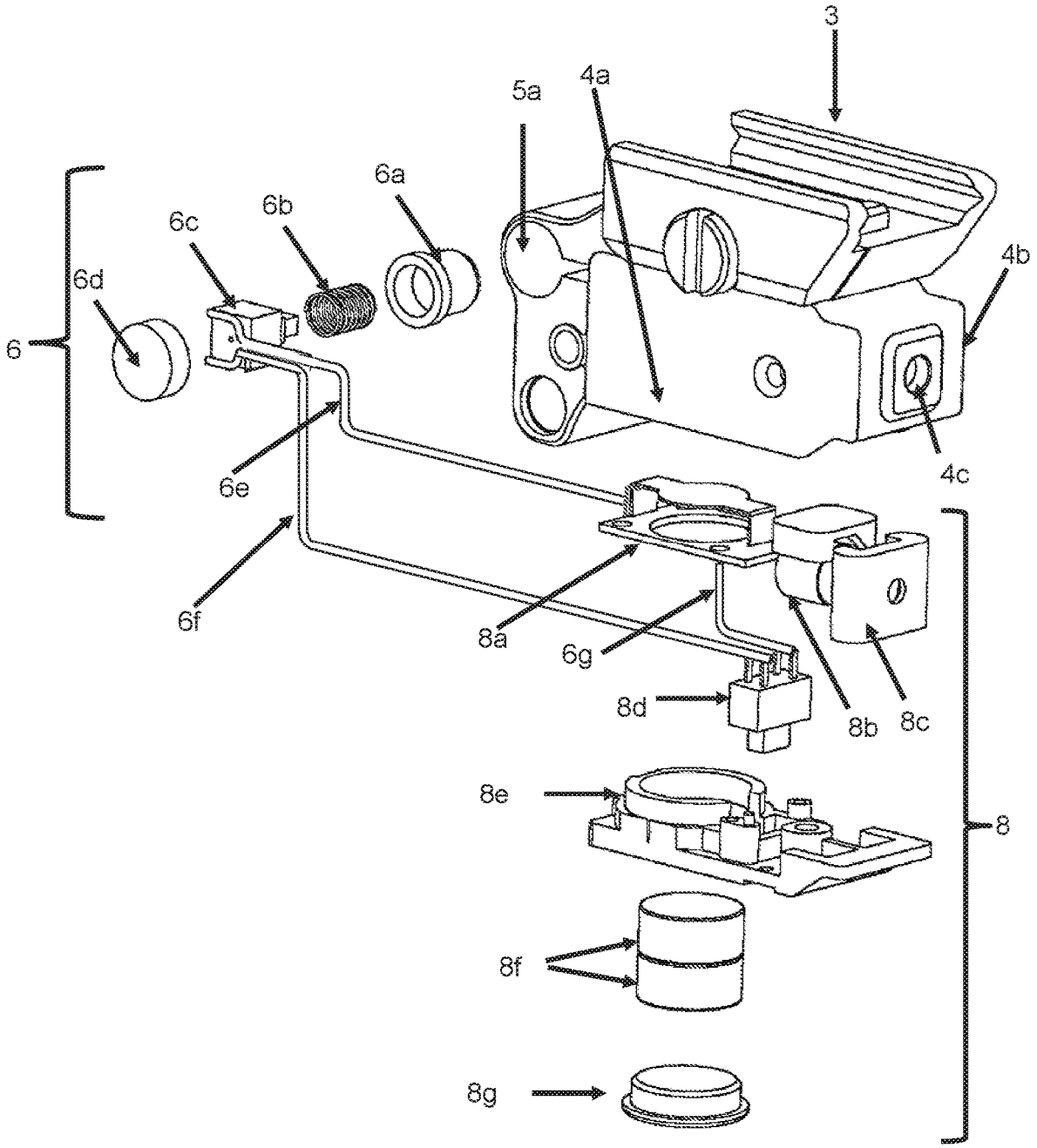
FIG. 2 is an exploded view of the clamp and laser assembly components of the laser sight trigger guard.

FIG. 2 depicts an exploded view of the first component showing the laser assembly 8 comprising the laser unit (8*a*-8*c*), the power supply (8*d*-8*g*) and the compressible on-off laser switch 6. The laser unit consists of a battery contact 8*a* for the battery, to which is operably connected to laser 8*b*, and laser guide 8*c*. The laser guide directs the laser light through opening 4*c* on the front surface at the proximal end of the first component.

The power supply comprises a slide switch connector 8*d*, a battery receptacle 8*e* that houses the button cell batteries 8*f* and a battery receptacle cover 8*g*. The on-off laser switch consists of an on-off push button 6*a* that abuts a spring 6*b* which is in operable communication with an on-off sensor switch 6*c* to which is attached an electrical wire(s) 6*e* that connects the on-off sensor switch to the contact. Electrical wire 6*f* connects the on-off sensor switch to the slide switch connector. Electrical wire 6*g* connects the slide switch connector to the contact. Thus, the slide switch connector works as a master switch that disconnects the batteries from the laser for long-term storage.

A cover 6*d* seals the on-off laser switch within the first compartment 5*a*. The on-off button protrudes out from the open end of the first compartment on the second side 4*b* of the first component (see FIG. 1D or 3C). With continued reference to FIGS. 1C and 1D, the second side member of the second component in the unpivoted position at 0° pushes the on-off button inwardly thereby disabling the on-off sensor switch from electrically connecting the power supply with the laser unit. Moving the second component to the swiveled position releases the on-off button thereby enabling the on-off sensor switch to electrically connect the batteries to the power supply thereby powering the laser unit and switching on the laser.

FIG. 3A depicts the laser sight trigger guard showing the second component 1*b* in the unswiveled position whereby on-off button 6*a* is depressed inside the first compartment at the distal end of the first component 1*a*.

With continued reference to FIG. 3A, FIG. 3B is a magnified view showing the on-off push button 6*a* compressing spring 6*b* to battery contact the on-off sensor switch 6*c*, whereby battery 8*f* and battery contact 8*a* are not electrically connected to the laser by the electric wires 6*e*, 6*f* and 6*g*.

With continued reference to FIGS. 2, 3A and 3B, FIG. 3C is a magnified view of the laser sight trigger guard showing the trigger guard 2 in a 90° pivoted position at which point the on-off button 6*a* is released to protrude outside the first compartment. This enables the spring 6*b* to decompress so that contact between the on-off sensor switch 6*c* and the on-off push button 6*a* is broken thereby electrically connecting the battery contact and battery in the power supply to the laser via electric wires 6*e*, 6*f* and 6*g* (see FIG. 2).

Figure 4A:
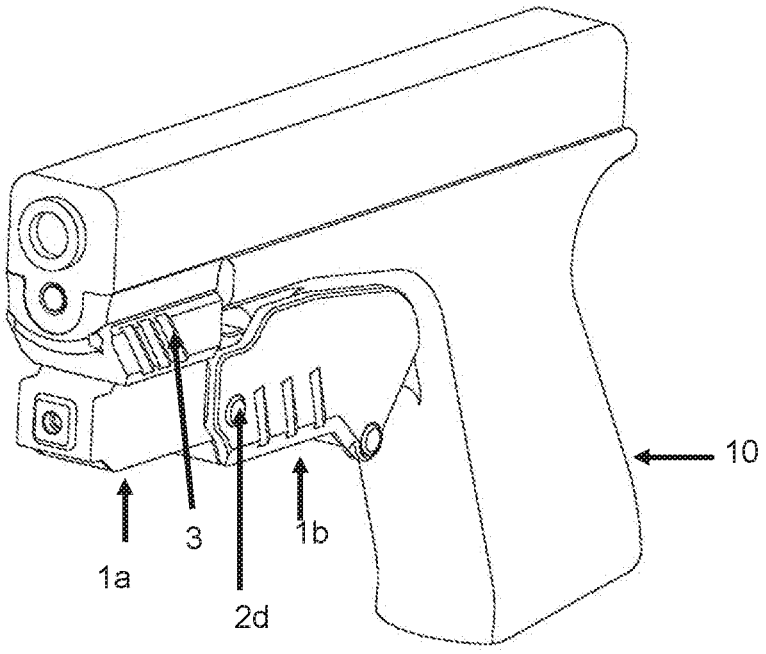
FIGS. 4A-4B show the laser sight trigger guard mounted on a pistol.

FIG. 4A. depicts the laser sight trigger guard secured by rail mount 3 to a handgun 10. The trigger guard 2 is in the unpivoted 0° position to cover the trigger and to keep the laser turned off.

Figure 4B:
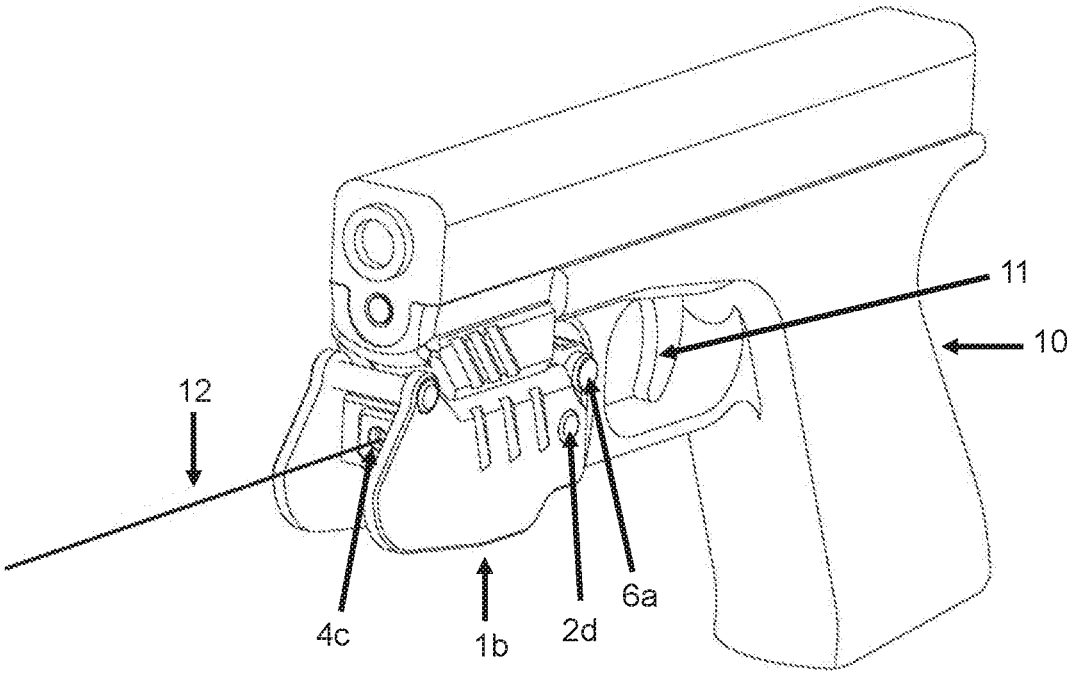

With continued reference to FIG. 4A, FIG. 4B shows the laser sight trigger guard with the trigger guard pivoted by 180° around the pivoting means 2*d*. This releases the on-off button 6*a* thereby activating laser 12 and uncovering the trigger 11.

The present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A laser sight trigger guard for a handgun, comprising:
a first component securable to a gun barrel on the handgun, comprising:
a body comprising a first side and a second side in parallel therewith, a hollow proximal end with an opening formed on a front surface thereof and a distal end with a first compartment, a second compartment and a third compartment each formed laterally through a back surface thereof and each independently having at least one coverable open end;
a rail mount disposed on a top surface of the proximal end of the body engageable with a rail on the gun barrel; and
a laser assembly disposed within the body of the first component; and
a second component pivotably secured to the first component at the distal end thereof, comprising:
a first side member and a second side member connected thereto oppositely disposed in parallel in a coverable relationship with a trigger on the handgun; and
an attachment shaft with a first end and a second end attached to the first side member and to the second side member at respective distal ends thereof;
wherein the second compartment comprises means for pivoting the second component through 180 degrees; and
wherein the third compartment comprises means for reducing friction between the first component and the second component when the second component is pivoted through 180 degrees.

2. The laser sight trigger guard of claim 1, further comprising a belt clip disposed on the second component.

3. The laser sight trigger guard of claim 1, wherein the first compartment comprises means for switching a laser on and off.

4. The laser sight trigger guard of claim 1, wherein the means for pivoting the second component comprises a pivot with a first pivot end and a second pivot end disposed within the second compartment, said first pivot end and said second pivot end pivotably connected to the first side member and to the second side member at respective proximal ends thereof through the open ends of the second compartment.

5. The laser sight trigger guard of claim 1, wherein the means for reducing friction comprises a pair of ball bearing disposed at the open ends of the third compartment.

6. The laser sight trigger guard of claim 1, wherein said rail mount further comprises means for securing the rail mount to the rail.

7. The laser sight trigger guard of claim 1, wherein the second component is configured to pivot in relation to a longitudinal axis of the gun barrel from 0° when the second component covers the gun trigger to 180° when the first side member and the second side member of the second component cover the first side and the second side of the first component.

8. The laser sight trigger guard of claim 1, wherein the laser assembly comprises:

a laser unit comprising a laser source in optical alignment with the opening formed on the front surface of the proximal end in the body;

an on-off laser switch disposed within the first compartment in on-off communication with the laser source, said on-off laser switch in an off position when the second component is disposed around the trigger and in an on position when the second component is disposed around the first component; and a power supply in electrical communication with the laser unit and the on-off laser switch.

9. The laser sight trigger guard of claim 8, wherein the on-off laser switch comprises:

an on-off push button with an outer surface and an inner surface disposed through the open end of the first compartment on the second side of the first component with the outer surface protruding from the open end when the laser is on and the inner surface extending within the first compartment;

an on-off sensor switch with a front end and a back end and means for contacting the power source disposed on the back end thereof, said on-off sensor switch disposed within the first compartment in alignment with and contactable by the inner surface of the on-off push button;

a spring disposed between and abutting the inner surface of the on-off push button and the front end of the on-off sensor switch surface; and a cover disposed over the open end of the first compartment on the first side of the first component.

10. The laser sight trigger guard of claim 8, wherein the power supply comprises:

a battery receptacle;

at least one battery seated in the battery receptacle and operably connected to the on-off laser switch; and a slide switch connector seated in the battery receptacle in operable communication with the at least one battery and with the laser source.

11. A laser sight trigger guard for a handgun, comprising:

a first component removably attached to a gun barrel comprising:

a body with a first side and a second side in parallel therewith, a hollow proximal end with an opening formed on a front surface thereof and a distal end with a first compartment, a second compartment and a third compartment each formed laterally through a back surface thereof and each independently having at least one coverable open end;

a rail mount disposed on a top surface of the proximal end of the body engageable with a rail on the gun barrel; and a laser assembly disposed within the body of the first component, said laser assembly comprising:

a laser unit comprising a laser source in optical alignment with the opening formed on the front surface of the proximal end in the body and an on-off laser switch disposed within the first compartment in on-off communication with the laser source, said on-off laser switch in an off position when the second component is disposed around the trigger and in an on position when the second component is disposed around the first component; and a power supply in electrical communication with the laser unit and the on-off laser switch, said power supply comprising a battery receptacle and at least one battery seated therein operably connected to the laser unit; and a second component pivotably secured to the second component at the distal end thereof, comprising:

a first side member and a second side member connected thereto oppositely disposed in parallel in a coverable relationship with a trigger on the handgun; and an attachment shaft with a first end and a second end attached to the first side member and to the second side member at respective distal ends thereof;

wherein the second compartment comprises means for pivoting the second component through 180 degrees; and wherein the third compartment comprises means for reducing friction between the first component and the second component when the second component is pivoted through 180 degrees.

12. The laser sight trigger guard of claim 11, further comprising a belt clip disposed on the second component.

13. The laser sight trigger guard of claim 11, wherein the means for pivoting the second component comprises a pivot with a first pivot end and a second pivot end disposed within the second compartment, said first pivot end and said second pivot end pivotably connected to the first side member and to the second side member at respective proximal ends thereof through the open ends of the second compartment.

14. The laser sight trigger guard of claim 11, wherein the means for reducing friction comprises a pair of ball bearing disposed at the open ends of the third compartment.

15. The laser sight trigger guard of claim 11, wherein said rail mount further comprises means for securing the rail mount to the rail.

16. The laser sight trigger guard of claim 11, wherein the second component is configured to pivot in relation to a longitudinal axis of the gun barrel from 0° when the second component covers the gun trigger to 180° when the first side member and the second side member of the second component cover the first side and the second side of the first component.

17. The laser sight trigger guard of claim 11, wherein the on-off laser switch comprises:

an on-off push button with an outer surface and an inner surface disposed through the open end of the first compartment on the second side of the first component with the outer surface protruding from the open end when the laser is on and the inner surface extending within the first compartment;

an on-off sensor switch with a front end and a back end and means for contacting the power source disposed on the back end thereof, said on-off sensor switch disposed within the first compartment in alignment with and contactable by the inner surface of the on-off push button;

a spring disposed between and abutting the inner surface of the on-off push button and the front end of the on-off sensor switch surface; and a cover disposed over the open end of the first compartment on the first side of the first component.

18. The laser sight trigger guard of claim 11, wherein the power supply further comprises a slide switch connector seated in the battery receptacle and in operable communication with the at least one battery and with the laser source.

* * * * *